US006425389B1

(12) United States Patent
Mühle

(10) Patent No.: US 6,425,389 B1
(45) **Date of Patent: *Jul. 30, 2002**

(54) GAS BURNER CONFIGURATION FOR COOKING AREAS

(75) Inventor: Bernd Mühle, Kirchanschöring (DE)

(73) Assignee: BSH Bosch und Siemens Hausgeraete GmbH, Munich (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/220,236

(22) Filed: Dec. 23, 1998

(30) Foreign Application Priority Data

Dec. 23, 1997 (DE) ..... 197 57 731

(51) Int. Cl.[7] ..... F24C 15/10
(52) U.S. Cl. ..... 126/39 R; 431/284
(58) Field of Search ..... 126/39 R, 39 BA, 126/39 E, 39 N, 39 K, 39 J; 431/354, 280, 284; 132/625.12, 891; 239/419.5, 425.5

(56) References Cited

U.S. PATENT DOCUMENTS 601,039 A * 3/1898 Griswold et al. ..... 126/39 K
1,456,754 A * 5/1923 Anderson ..... 239/425.5
1,878,143 A * 9/1932 Hobson ..... 126/39 K
1,896,082 A * 2/1933 Harper ..... 126/39 N
2,043,382 A * 6/1936 Leonard ..... 126/39 K
2,781,779 A * 2/1957 Kindl ..... 126/39 N
3,785,364 A * 1/1974 Reid, Jr. et al. ..... 126/39 J
3,843,313 A * 10/1974 Helgeson ..... 126/39 J
4,889,103 A 12/1989 Fraioli
4,899,723 A 2/1990 Pajares
5,653,219 A * 8/1997 Taplan et al. ..... 126/39 R

FOREIGN PATENT DOCUMENTS

GB 2 178 525 A 2/1987
GB 2 184 535 A 6/1987
GB 2 266 140 A 10/1993

* cited by examiner

*Primary Examiner*—Sara Clarke
(74) *Attorney, Agent, or Firm*—Laurence A. Greenberg; Werner H. Stemer; Gregory L. Mayback

(57) ABSTRACT

A gas burner configuration has two cooking areas disposed symmetrically in a cooker hob. The gas burner configuration has gas fittings that influence a gas flow to each of the cooking areas and whose actuating members extend out from the front of an operating panel. The cooking areas have similarly constructed burner units with gas/air mixture feed ducts which are aligned in a V-shaped fashion with gas outlet nozzles of gas nozzles of, in each case, one gas injector nozzle configuration of the gas fittings disposed in a front area of the cooker hob.

5 Claims, 4 Drawing Sheets

GAS BURNER CONFIGURATION FOR COOKING AREAS

BACKGROUND OF THE INVENTION

1. Field of the Invention

The present invention relates to a gas burner configuration having two cooking areas disposed symmetrically in a cooker hob and having in each case a gas fitting which influences the gas feed to the cooking areas and whose actuating members extend out from an operating panel.

Gas burner configurations having two cooking areas disposed symmetrically in a cooker hob can, when provided with an appropriate housing, be a component of a self-contained appliance, but they can also be used as a built-in cooking trough in a work plate of a kitchen range. Each of the cooking areas is assigned a gas fitting via which it is possible for the gas to be supplied to the cooking areas and for the ignition operations to be carried out by operating members which operators can reach. Since the combustion gas must be led to the individual cooking areas and be made available to the individual cooking areas from a common gas supply point which is implemented locally—for example, in the form of bottles of stored liquid gas, or as a central gas connection, via physical pipelines and gas ducts it is necessary to take account of these structurally conditioned constraints. Thus, for example, it is possible for the burner head of each cooking area to be assigned its gas fitting at right angles to the operating front, in order to be able to configure both the burner unit and the gas fitting in a uniform fashion. However, if the actuating elements for the gas fittings are to be moved closer together than the cooking areas assigned to them, it is necessary, within the scope of the configurations that have become known, either to make use of appropriately adapted different burner fitting units, or to compensate for spacings by a control linkage or by cardan shafts which lead from the actuating elements to fittings at an appropriate distance away.

SUMMARY OF THE INVENTION

It is, accordingly, an object of the invention to provide a gas burner configuration for cooking areas which overcomes the above-mentioned disadvantages of the prior art devices of this general type, in which two cooking areas are disposed symmetrically in a cooker hob with actuating members moved together relative to the cooking areas such that the configuration and construction require as few different individual components as possible.

With the foregoing and other objects in view, there is provided, in accordance with the invention, a gas burner configuration, including: a cooker hob having a front area; two cooking areas disposed symmetrically in the cooker hob, the two cooking areas having substantially identical burner units and gas/air mixture feed ducts connected to the burner units; and gas fittings having gas/air injector configurations with gas outlet nozzles disposed in the front area of the cooker hob, the gas/air mixture feed ducts of the two cooking areas are aligned in a V-shaped fashion with the gas outlet nozzles of the gas fitting, the gas fittings having actuating members associated with each of the two cooking areas for influencing a gas flow to the two cooking areas and the actuating members are to be disposed to extend out from an operating panel.

A gas burner configuration that has two cooking areas disposed symmetrically in a cooker hob and meets these requirements is defined according to the invention in that similarly constructed burner units are disposed with their gas/air mixture feed ducts aligned in a V-shaped fashion with the gas outlet nozzles. The gas outlet nozzles are functionally a component of the gas injector nozzle configuration for supplying the gas/air mixture suitable for combustion. The gas fittings are juxtaposed in the front area of the cooker hob.

In this connection, a gas burner configuration according to the invention having two-ring burners is preferably defined in that, for the purpose of feeding gas to the annular outer burner, the gas/air mixture feed ducts of the gas burners are disposed aligned in a V-shaped fashion with the assigned gas outlet opening of the assigned gas fitting, and, including gas feed lines for feeding gas to the inner burner, are in an aligned fashion from the side of the gas burners which is averted from the gas/air mixture feed pipes for the outer burner.

In this connection, both the similarly constructed burner units and the symmetrically configured gas fittings are disposed fixed on a common support plate structure, thus ensuring the individual elements are assigned reliably in terms of function without expensive adjusting work. The overall configuration permits a very compact construction and the possibility of accommodating the actuating members for the gas fittings in a way in which they are brought together close to one another centrally in the front of the cooker hob. The actuating members are disposed in a fashion dropping obliquely toward the front of the cooker hob. This is particularly advantageous for operation and favorable for manufacture.

According to a preferred refinement, the gas burner configuration according to the invention is defined in that, in addition to the actuating members for influencing the gas fittings, further actuating members are disposed for controlling the air intake by the gas flowing in via the gas nozzle and thus the air feed in the region of the gas injector nozzle configuration.

In accordance with an added feature of the invention, the cooker hob, including the gas fittings and the two cooking areas, is a cooker trough that can be inserted into a section of a work plate.

In accordance with a concomitant feature of the invention, the cooker hob has a housing and is a self-contained gas cooking appliance.

Other features which are considered as characteristic for the invention are set forth in the appended claims.

Although the invention is illustrated and described herein as embodied in a gas burner configuration for cooking areas, it is, nevertheless, not intended to be limited to the details shown since various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
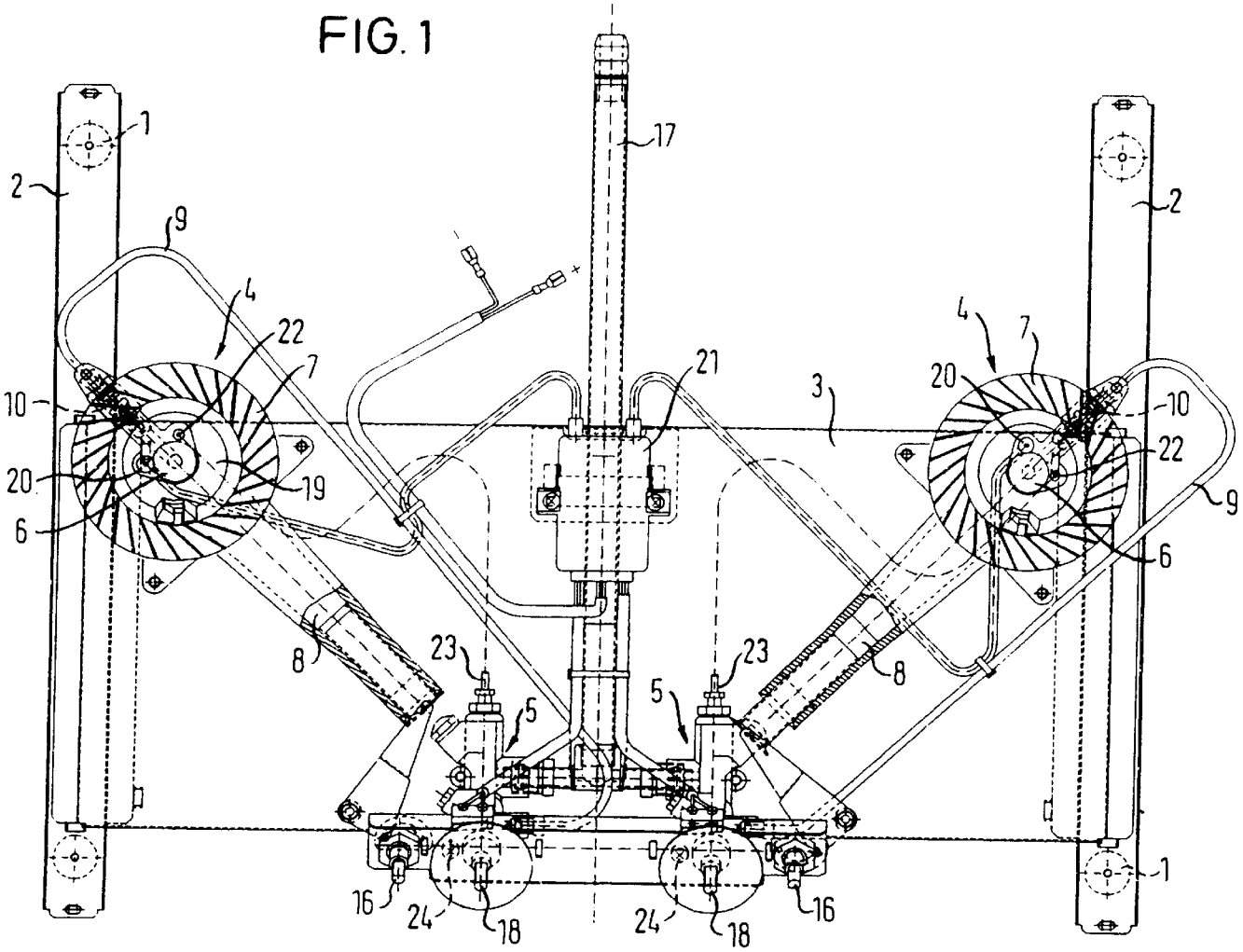
FIGS. 1 and 2 are top plan views of configurations having in each case two cooking areas and associated burner fittings, without an associated housing and, respectively, without an associated cover with pot supporting units according to the invention.

In all the figures of the drawing, sub-features and integral parts that correspond to one another bear the same reference symbol in each case. Referring now to the figures of the drawing in detail and first, particularly, to FIG. 1 thereof, there are shown gas burner configurations 4 and associated gas fittings 5 for two cooking areas. The two cooking areas are fastened on a basic frame, including two angle strips 2 fitted with feet 1 and a base-plate 3 situated therebetween. The gas burner configurations 4, which are of identical construction, each have a burner formed of two burner rings, specifically an inner burner 6 and an outer burner 7 disposed around the latter. The gas burner configurations 4 are aligned in a V-shaped fashion in a direction of the gas fittings 5 with their feed duct 8 for a gas/air mixture intended for the outer burner 7. Provided in the plane perpendicular to the gas/air feed duct 8 for the outer burner 7 of each of the gas burner configurations 4 is a connection for a gas line 9. The gas line 9 departs from a respective fitting 5 and leads to a gas injector nozzle configuration 10 disposed in each of the burner heads of each of the gas burner configurations 4. The intake of the primary air to the gas injector nozzle configuration 10 is cleared via an opening 11 (FIG. 6) on the underside of the burner head. The gas mixes with the primary air in a duct 12 (FIG. 2) leading to the inner burner 6 to form a mixture that burns well. The secondary air required for the inner burner 6, and also a necessary partial quantity of secondary air for the outer burner 7 passes to flame regions through a clearance opening 19 (FIG. 6) between the inner burner 6 and the outer burner 7.

The gas coming from the gas fittings 5 is blown into the gas/air feed duct 8 by a gas nozzle 13 (FIG. 2), which is a constituent of the gas fittings, primary air being entrained. The intensive mixing of gas blown in and air inducted toward the outer burner 7 takes place in the gas/air feed duct 8, which is of adequate length.

Figure 4:
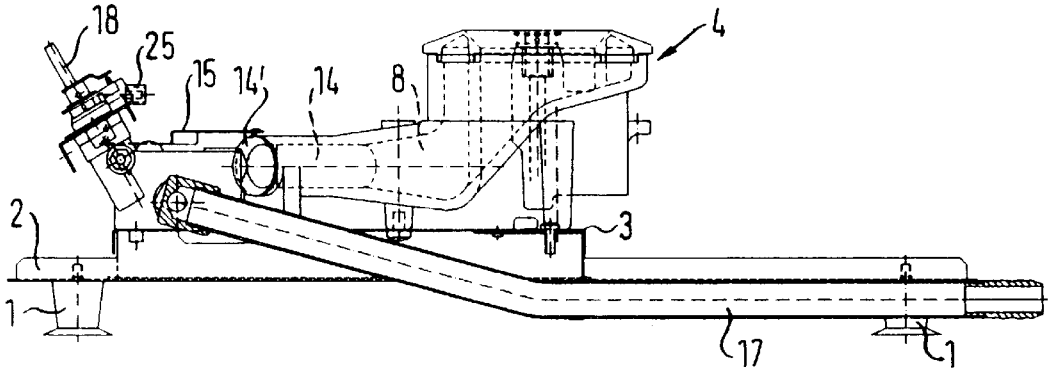
FIGS. 4–6 are side-elevational, partly sectional views of burner units.
Figure 5:
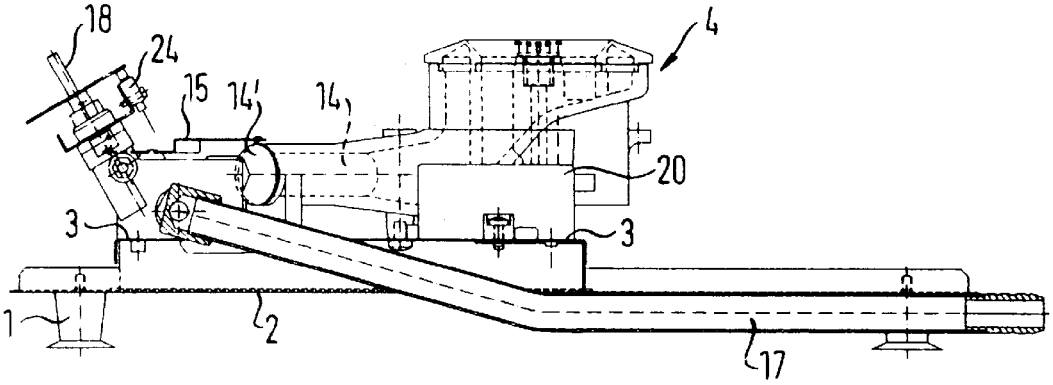
Figure 6:
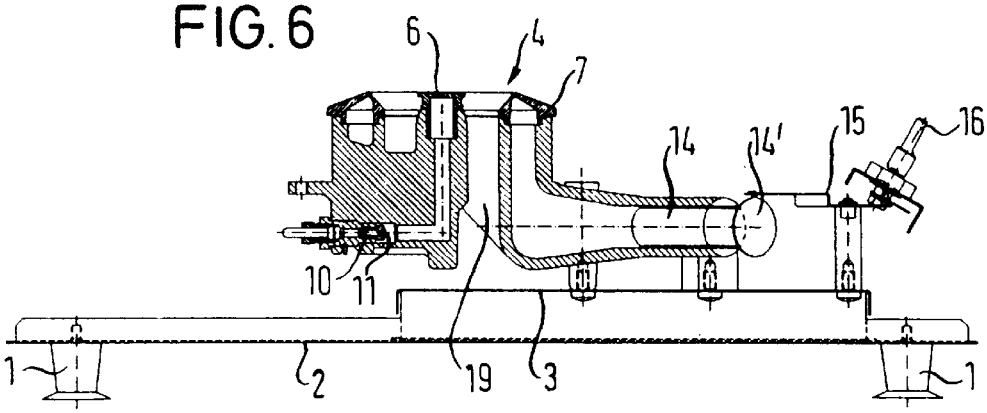

In order to be able to adapt the air feed individually to the rate of outflow and type of gas used, the inlet opening of the gas/air feed duct 8 is assigned an axially displaceable pipe connector 14 with an induction funnel 14' (FIGS. 4–6). Via the axially displaceable pipe connector 14, 14', the effective spacing of the gas/air feed duct 8 can be varied toward the nozzle 13, as a result of which the air induction can also be varied. The pipe connector 14 can be actuated via an angle lever 15, mounted in the base plate 3, by a finger-grip knob configuration 16 whose non-illustrated actuating knob projects from an operating panel (likewise not represented).

The gas feed for the gas burner configurations 4 of the two cooking areas of the cooker hob is performed centrally via a gas line 17 which is connected to the two gas fittings 5 in a fashion branched like a T between the two gas fittings 5. The two gas fittings 5 are constructed and disposed symmetrically relative to one another. They each contain three gas duct branches that can be opened and closed via a finger-grip knob configuration 18, via a non-illustrated actuating knob projecting above the non-illustrated operating panel. One of the gas duct branches in the gas fittings 5 is configured for constant gas throughput and assigned to the inner burner 6 via the gas feed line 9. After an initial rotary movement of the finger-grip knob configuration 18, the gas duct branch is fully open, specifically for the entire further adjustment path of the finger-grip knob configuration 18. The flame at the inner burner 6 can also be ignited in the initial position, in which the gas duct branch is open. An igniting electrode 20 is disposed for this purpose in the vicinity of the inner burner 6. The ignition voltage for generating the igniting sparks is generated in the case of the embodiment according to FIGS. 1 and 5 with the aid of an ignition generator 21 which is activated by a contact 24. The contact 24 is actuated by the finger-grip knob configuration 18, for example by pressing in axially or, in the case of the embodiment according to FIGS. 2 and 4, by actuating a piezoelectric element on which the finger-grip knob configuration 18 acts, by virtue of the fact that, in a fashion prepared by the preliminary rotary movement or pressing-in movement of the finger-grip knob configuration 18, a striking movement is exerted on the piezoelectric element 25 at the instant when the gas duct branch is opened.

Figure 2:
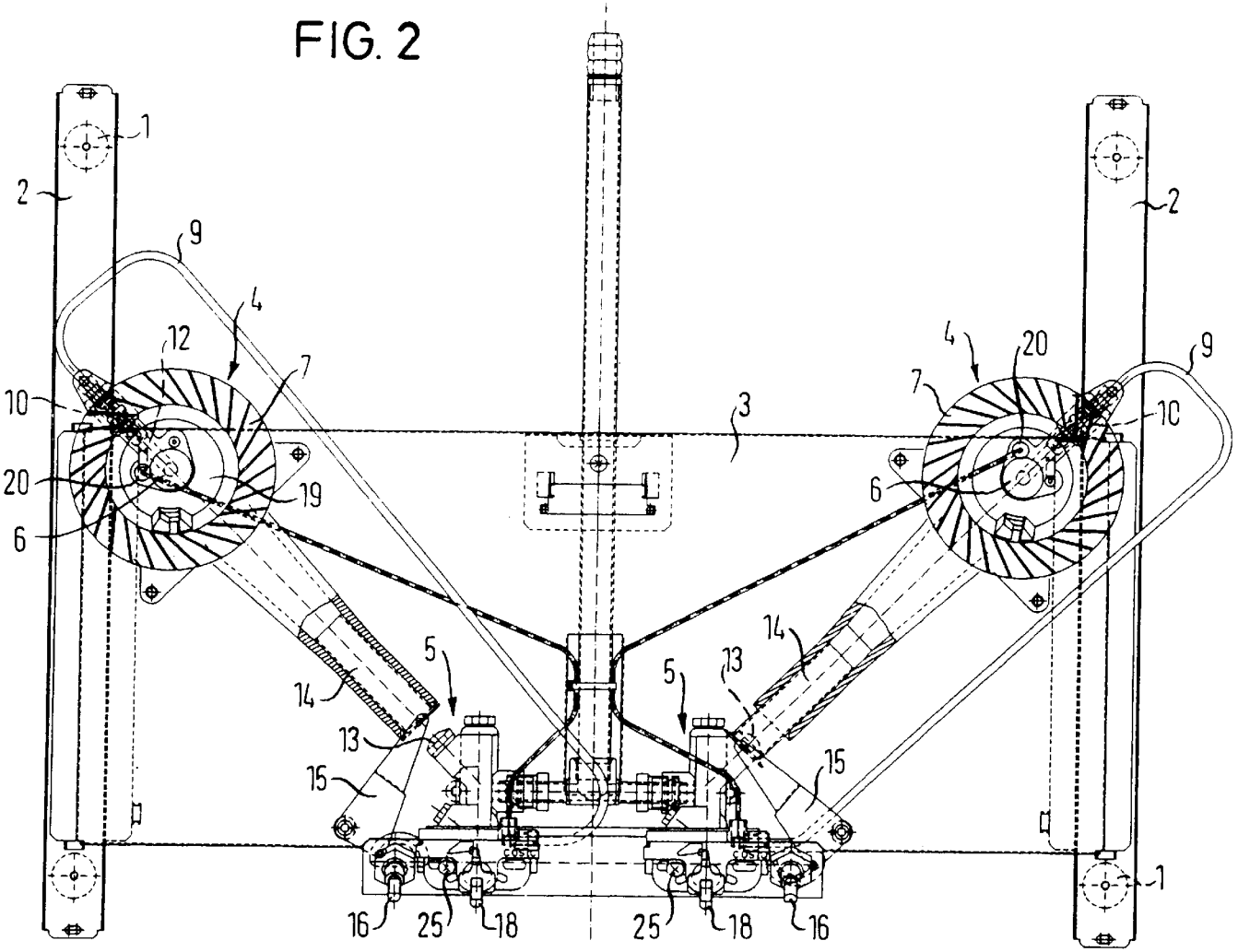
Figure 3:
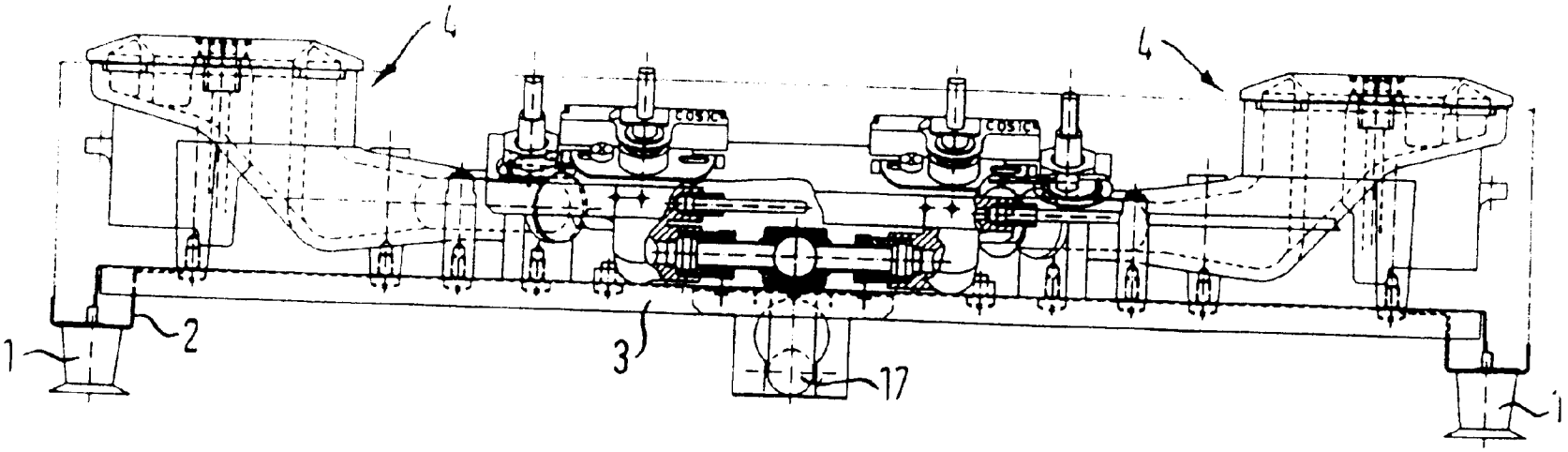
FIG. 3 is a front elevational view of the configuration.

As may be seen from FIG. 1, there is also disposed, if required, in the vicinity of the inner burner 6, a thermocouple 22 via which a main valve 23 for the exit of gas is held open as long as the flame is present at the inner burner 6.

After a further angle of rotation, after which the first gas duct branch is open for the inner burner 6, and the flame has been ignited at the inner burner 6, two further gas duct branches are completely opened, which are assigned to the nozzle 13 and thus to the outer burner 7 of each of the gas burner configurations 4. The flame of the outer burner 7 is ignited in this case by the flame of the inner burner 6. One of the two gas duct branches assigned to the outer burner 7 and extending to the gas nozzle 13 is variable with reference to the gas flow rate, and can be completely closed by the end of a prescribed angle of rotation of the finger-grip knob configuration 18. The second of the gas duct branches extending to the gas nozzle 13 remains fully open during this time and serves to ensure that gas is fed to the outer burner 7 in conjunction with a minimum heating power.

The configuration of the gas burners for the two cooking areas is configured and selected such that recourse may be made to components which are as simple and similar as possible for the two cooking area units. The gas fittings 5 and their assigned adjusting mechanisms for adding air in the region of the nozzles 13 are constructed in the fashion of mirror images and as far as possible in a corresponding fashion. The construction of the two-ring gas burner configurations 4 is completely identical in each case. Nevertheless, the construction permits the actuating elements for the separately situated cooking area regions to be moved near one another on the front operating panel and to form an actuating block.

I claim:

1. A gas burner configuration, comprising:

a cooktop having a front area;

two cooking areas disposed symmetrically in said cooktop;

said two cooking areas having substantially identical gas burner units and gas/air mixture feed ducts connected to said gas burner units;

said gas burner units each having an inner burner ring and an annular outer burner ring connected to a respective one of said gas/air mixture feed ducts for feeding gas to said annular outer burner ring;

a gas feed line feeding gas to said inner burner ring from a side of said gas burner units averted from said respective gas/air mixture feed duct connected to said annular outer burner ring;

two gas fittings symmetrically disposed relative to one another each having gas/air injector configurations with gas outlet nozzles, said gas outlet nozzles:

aligned in a V-shape; and disposed in said front area of said cooktop;

said gas/air mixture feed ducts of said two cooking areas aligned co-axially with said gas outlet nozzles of said gas fittings and aligned in a V-shape with respect to said gas fittings; and said gas fittings having actuating members associated with each of said two cooking areas for influencing a gas flow to said two cooking areas and said actuating members to be disposed to extend out from an operating panel.

2. The gas burner configuration according to claim 1, including further actuating members controlling an air feed in a region of said gas/air injector configurations.

3. The gas burner configuration according to claim 2, wherein said actuating members and said further actuating members are rotary members obliquely disposed with respect to a horizontal of said cooktop and disposed toward said front area of said cooker hob.

4. The gas burner configuration according to claim 1, wherein said cooktop including said gas fittings and said two cooking areas is a cooker trough that can be inserted into a section of a work plate.

5. The gas burner configuration according to claim 1, wherein said cooktop has a housing and is a self-contained gas cooking appliance.

* * * * *